US005621941A

United States Patent [19]

Liu

[11] Patent Number: 5,621,941

[45] Date of Patent: Apr. 22, 1997

[54] BABY BOTTLE CLEANING DEVICE INCLUDING DUAL BRUSHES

[76] Inventor: Chih C. Liu, No. 25, Lane 16, Tung-Hsing St., Shu Lin Town, Taipei Hsien, Taiwan

[21] Appl. No.: 563,721

[22] Filed: Nov. 28, 1995

[51] Int. Cl.[6] ..... A46B 5/02

[52] U.S. Cl. ..... 15/106; 15/160; 15/164; 15/206; 15/143.1; D4/119

[58] Field of Search ..... 15/164, 206, 211, 15/106, 143.1, 104.03, 104.04, 104.05, 176.1, 176.5, 145, 160, 159.1, 165; D4/105, 106, 132, 138, 133, 134, 119; D8/300, 301, 308, 309, DIG. 7, DIG. 10

[56] References Cited

U.S. PATENT DOCUMENTS

| | | | |
|---|---|---|---|
| D. 250,068 | 10/1978 | Ducotey | 15/164 |
| D. 352,832 | 11/1994 | Brazis et al. | D4/138 |
| D. 367,177 | 2/1996 | Berti | D4/138 |
| 956,641 | 5/1910 | Huddart | 15/164 |
| 3,230,563 | 1/1966 | Swanson | 15/164 |
| 3,760,449 | 9/1973 | Swanson | 15/206 |
| 3,862,461 | 1/1975 | Bucklitzsch | 15/164 |
| 4,056,863 | 11/1977 | Gunjian | 15/160 |
| 5,319,823 | 6/1994 | Baum et al. | 15/143.1 |

FOREIGN PATENT DOCUMENTS

| | | | |
|---|---|---|---|
| 369769 | 1/1907 | France | 15/164 |
| 704414 | 2/1931 | France | 15/206 |
| 269729 | 1/1914 | Germany | 15/164 |
| 20766 | of 1890 | United Kingdom | 15/164 |
| 24259 | of 1898 | United Kingdom | 15/164 |
| 817513 | 7/1959 | United Kingdom | 15/164 |

*Primary Examiner*—Gary K. Graham

[57] ABSTRACT

A baby bottle brush which near a bottom part of the shaft the main brush is bent to generally conform to the shape of the interior of a baby bottle. A secondary brush or a rod is also affixed to the handle of the brush. The secondary brush or rod holds the main brush against the surface of the bottle. The secondary brush and the rod may be used together. The handle is angled to facilitate a circular cleaning motion. A distal end of the handle includes a hook. The brush may be used on bottles other than baby bottles.

3 Claims, 9 Drawing Sheets

BABY BOTTLE CLEANING DEVICE INCLUDING DUAL BRUSHES

BACKGROUND OF THE INVENTION

1. Field of the Invention

The present invention relates to a double-brush baby bottle brush which is a main brush combined with a secondary brush in order to achieve faster cleaning.

2. Description of the Prior Art

Although there are many styles of conventional baby bottle brushes in the market, most of them are of the style with a large brush and small brush in a set. However, brushes need to turn many times to accomplish cleaning during washing. When you rotate the brush to clean the mouth of the bottle, the brush will slightly incline and turn round in the center of the bottle. Also, it is not easy to clean the bottle threads because the large brush is too long, and the small brush is too small. Therefore, some people use a scrub sponge as an additional tool to ensure the effectiveness of cleaning. According to practical requirements, the inventor has found if the bristles are too long, the cleaning force will be less and extend the time required to clean the bottle. So, the inventor has developed the present invention to solve the above problems and to provide a better way to clean a baby bottle.

SUMMARY OF THE INVENTION

The main purpose of the present invention is to provide a baby bottle brush which near a bottom part of the shaft the main brush is bent to generally conform to the shape of the interior of a baby bottle. A secondary brush or a rod is also affixed to the handle of the brush. The secondary brush or rod holds the main brush against the surface of the bottle. The secondary brush and the rod may be used together. The handle is angled to facilitate a circular cleaning motion. A distal end of the handle includes a hook. The brush may be used on bottles other than baby bottles.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
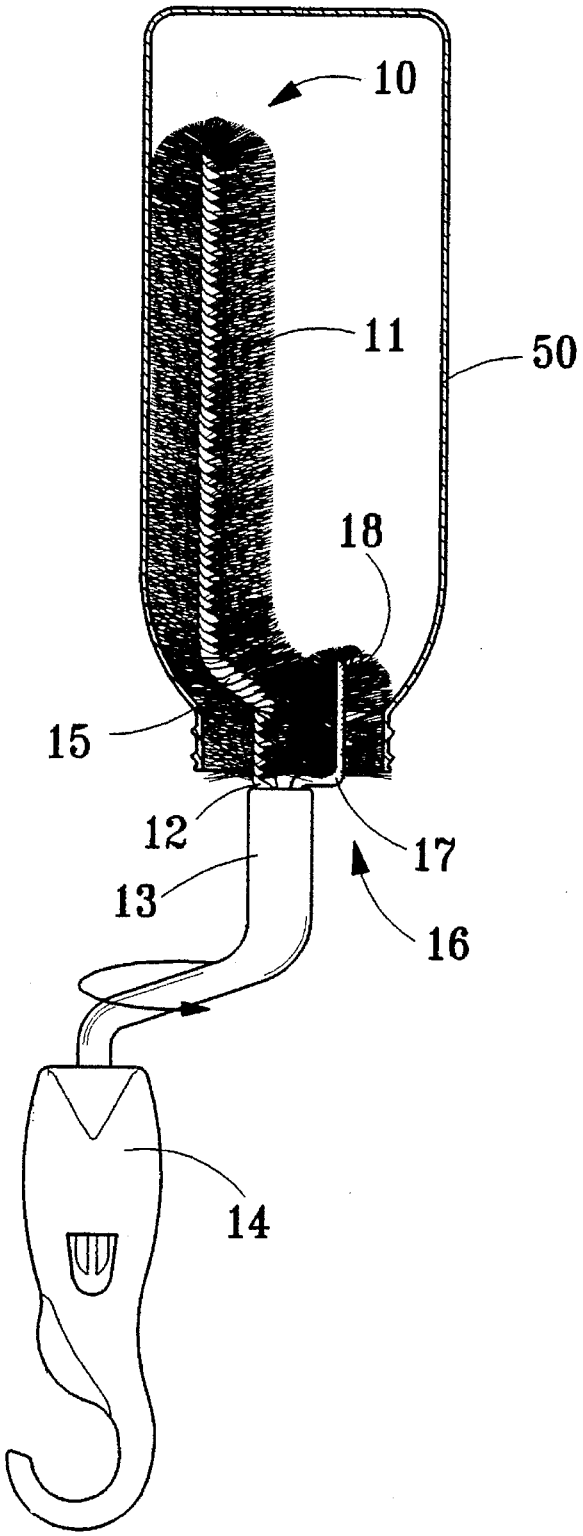
FIG. 1 is a diagrammatic view of cleaning the inside of a baby bottle using the brush of the present invention.
Figure 1A:
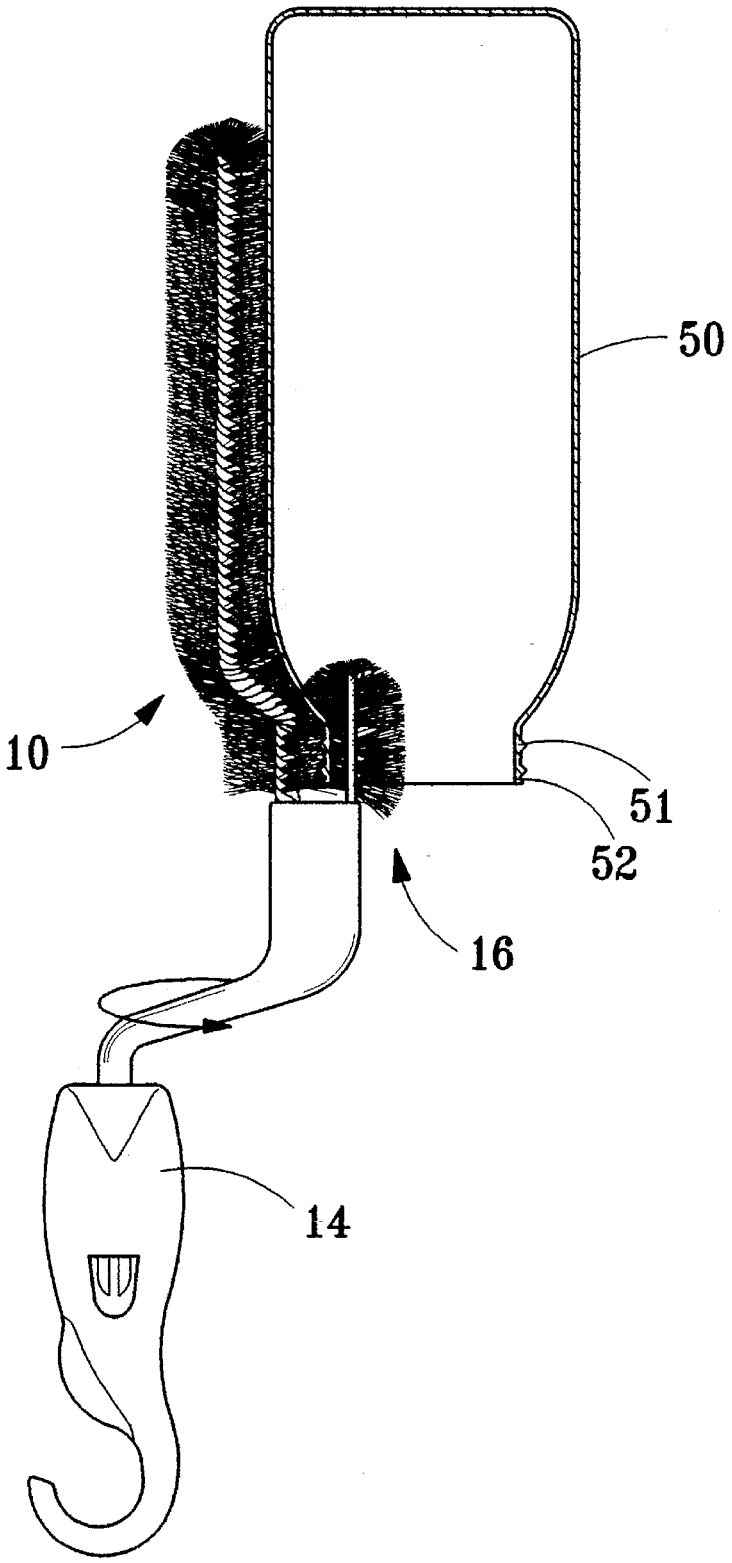
FIG. 1A is a diagrammatic view of cleaning the outside of the bottle.

FIGS. 1–6 show several embodiments of the baby bottle brush of the present invention. FIG. 1 shows the first embodiment in which the brush bristle 11 of main brush 10 attaches to a shaft 12 which includes an angled section 15. The angled section causes the brush to conform to the shape of a baby bottle. The angled section 15 is connected to an angled connecting shaft 13 of the handle 14. When the handle 14 turns, the connecting shaft 13 will drive the shaft 12 of the main brush 10, causing it, and the brush bristle 11, to rotate.

A secondary brush 16 is also affixed to the connecting shaft 13. The secondary brush 16 includes an angled shaft 17 and a secondary brush bristle 18. The length of the secondary brush is greater that the height of the bottle mouth.

Figure 2:
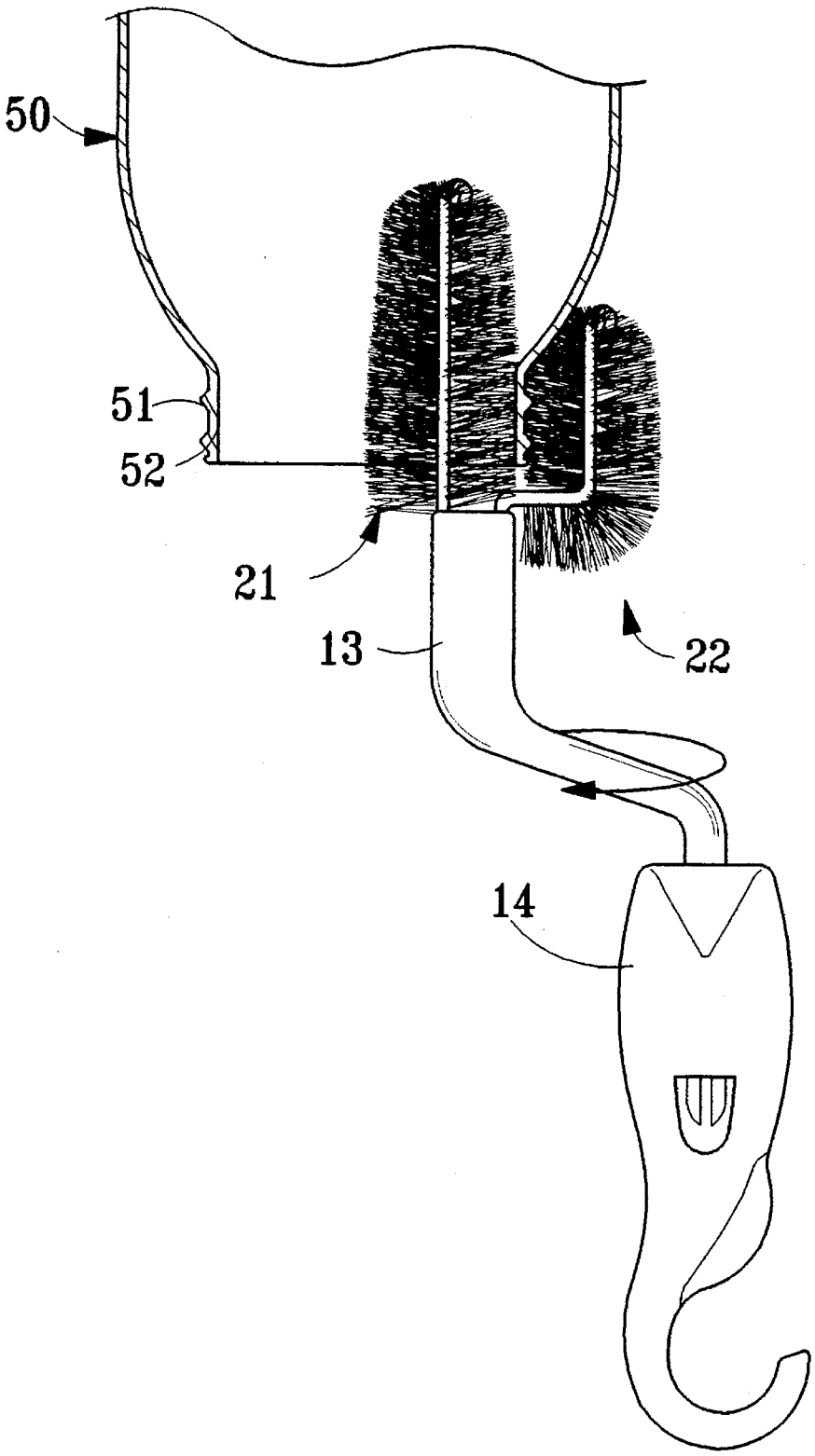
FIG. 2 is a diagrammatic view of a second embodiment of the present invention.
Figure 2A:
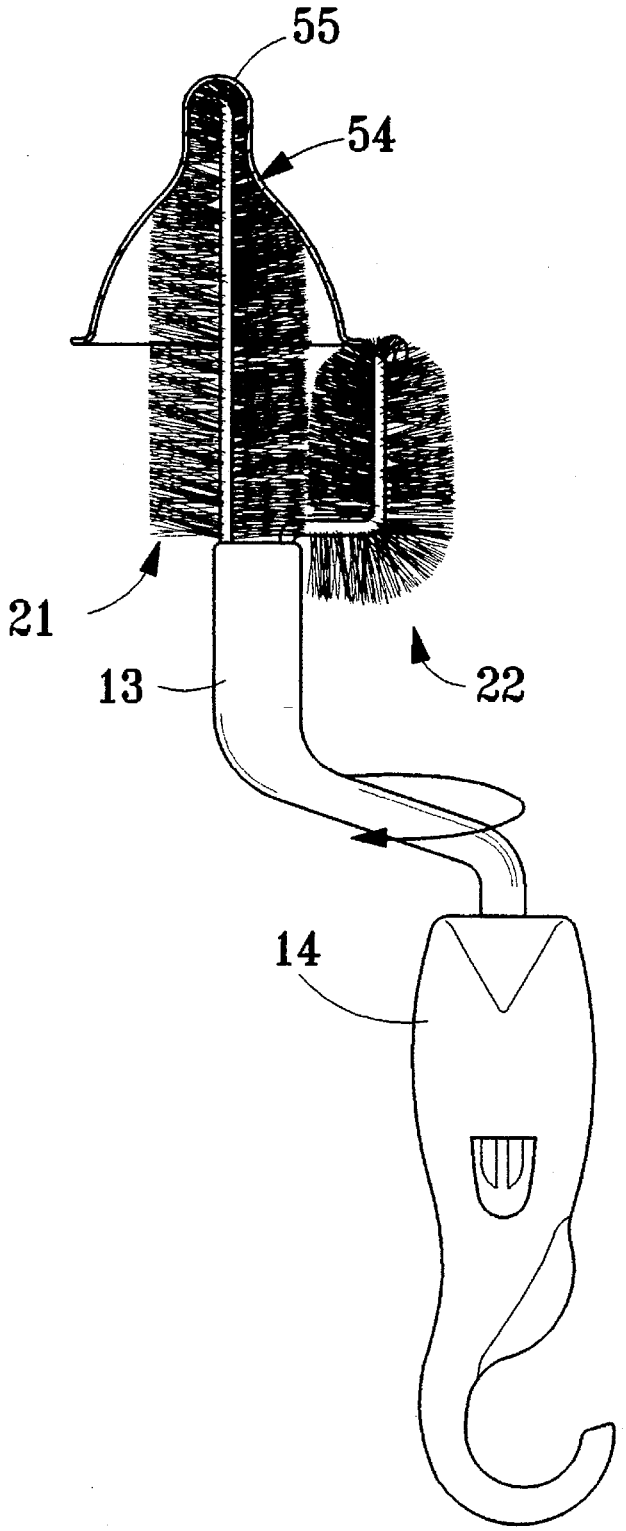
FIG. 2A is a diagrammatic view of the second embodiment cleaning a nipple of the bottle.

A second embodiment of the invention is shown in FIG. 2. A shorter main brush 21 replaces the main brush 10 of the first example, while the short secondary brush 22 is the same as the secondary brush 16. The short main brush 21 cleans the inner surface of the bottle-mouth 52 and the short secondary brush 22 cleans the outer thread 51. As shown in FIG. 2A, the user can also use the short main brush 21 to clean the inside of a nipple 54. In particular, the brush can clean the tip 55 of the nipple.

Figure 2B:
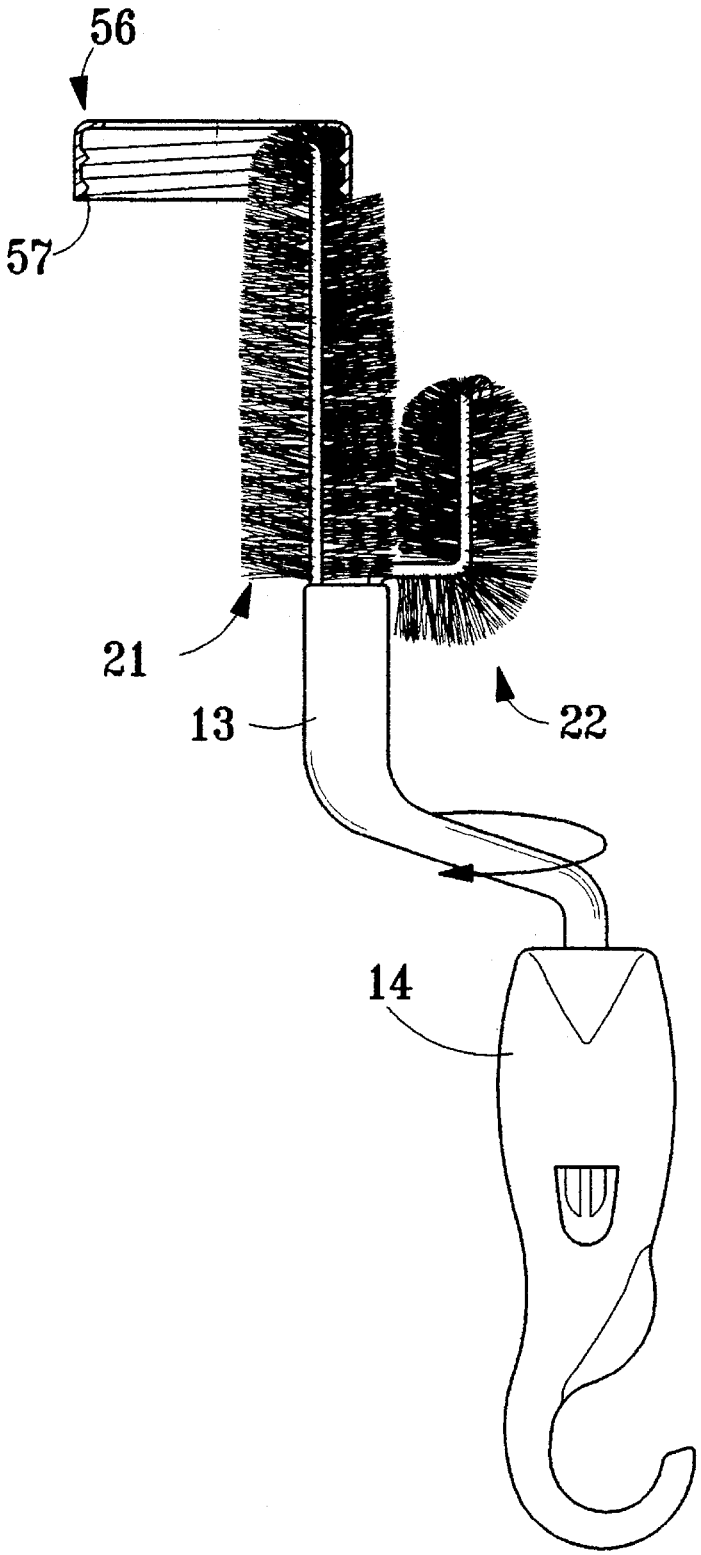
FIG. 2B is a diagrammatic view of the second embodiment cleaning a lid of the bottle.

As shown in FIG. 2B, the short main brush 21 and the short secondary brush 22 can be used to clean the inner thread 57 and the outer surface of bottle lid 56 of baby brush 50.

Figure 3:
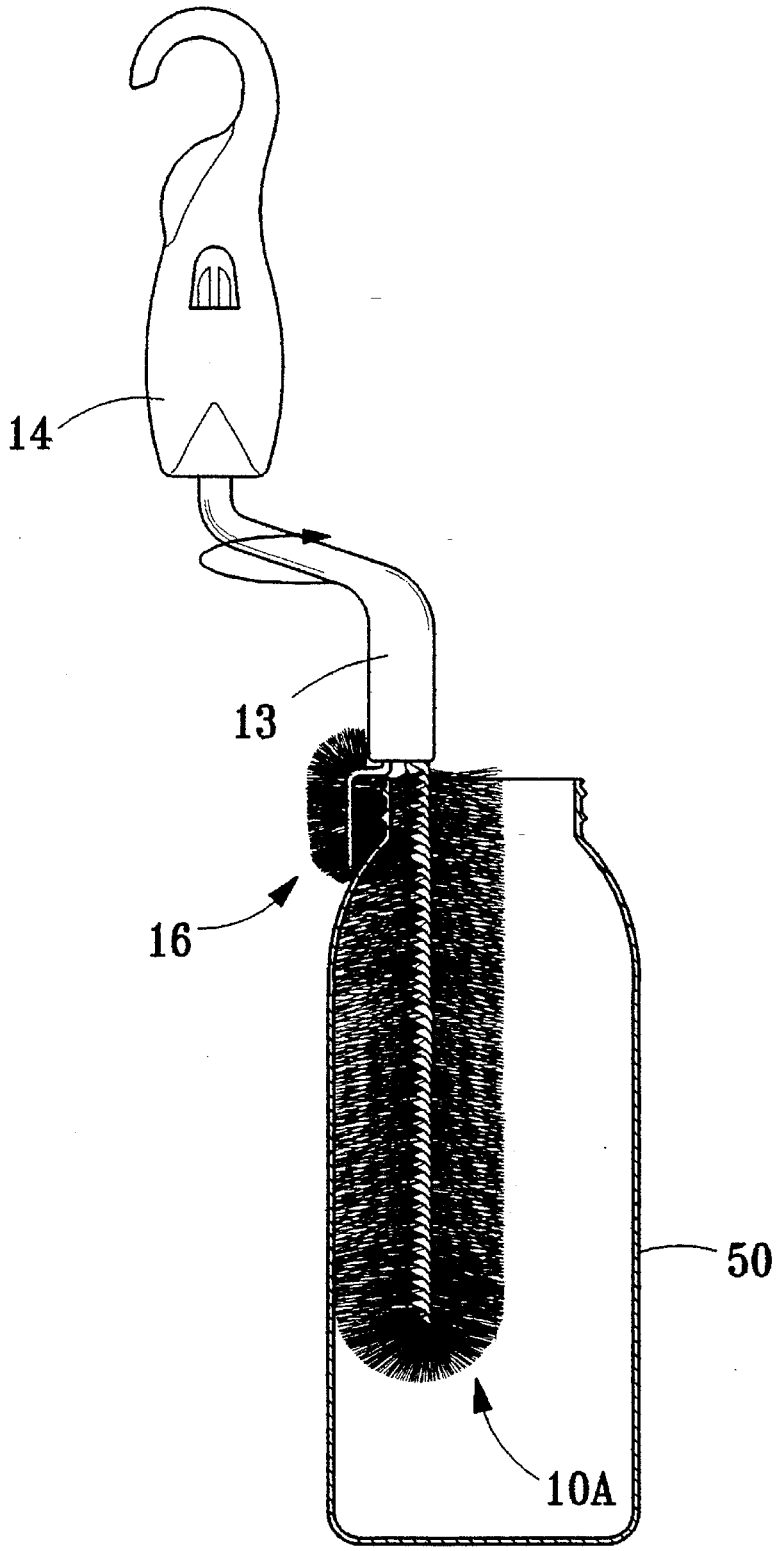
FIG. 3 is a diagrammatic view of a third embodiment of the present invention.
Figure 4:
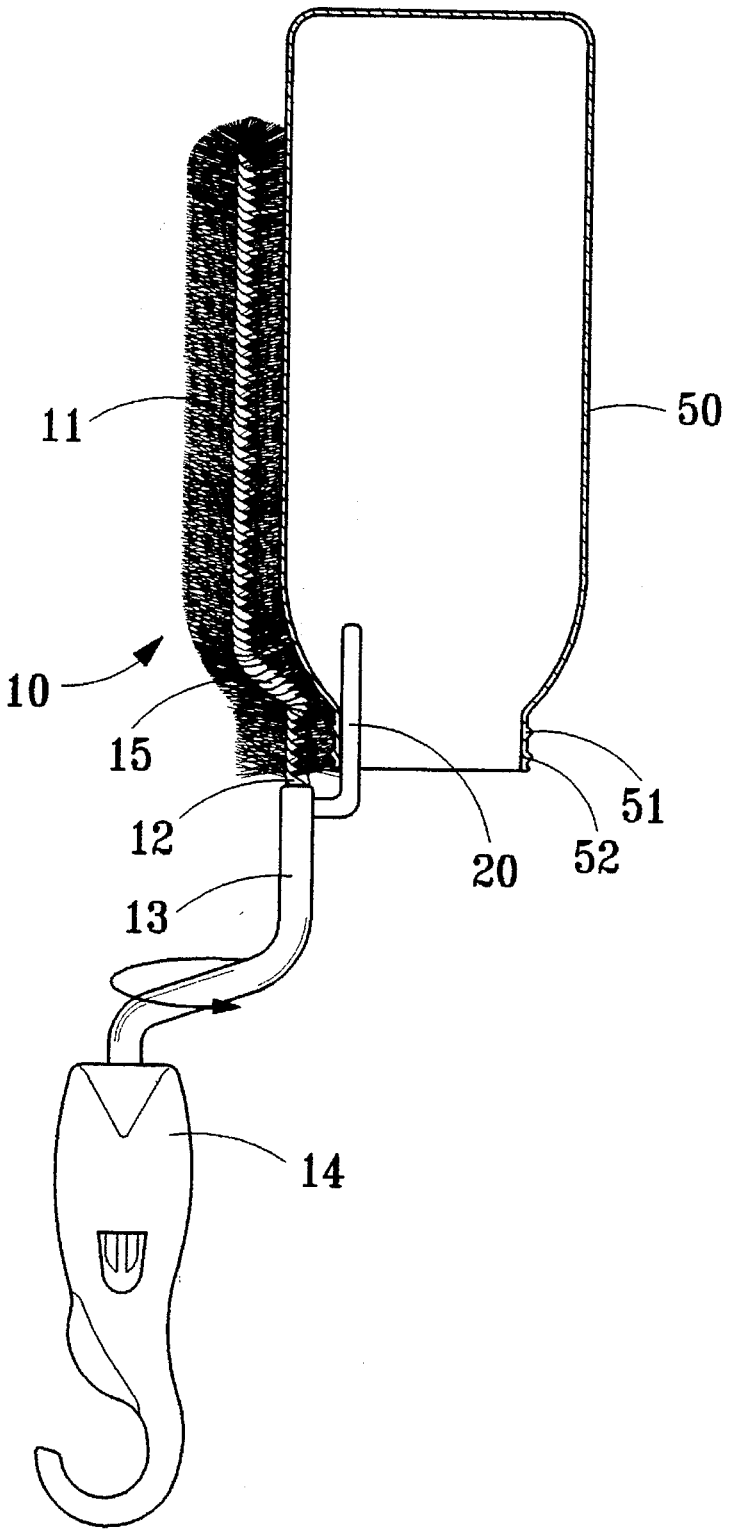
FIG. 4 is a diagrammatic view of a fourth embodiment of the present invention.

A third embodiment is shown in FIG. 3. The main brush 10A does not have an angled section 15.

Figure 5:
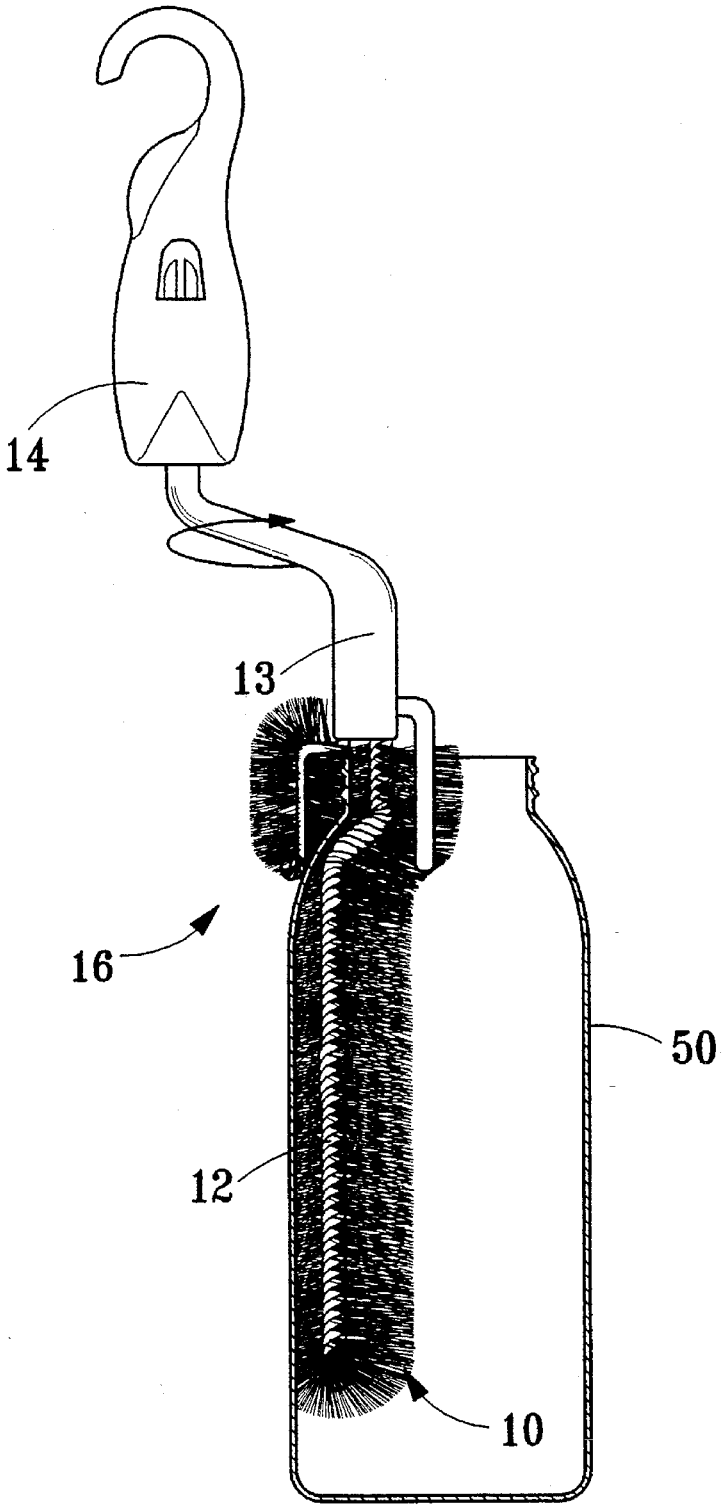
FIG. 5 is a diagrammatic view of a fifth embodiment of the present invention.

A fifth embodiment is shown in FIG. 5. The shaft 13 of main brush 10 is affixed to handle 14, as are the secondary brush 16 and short rod 20. With this embodiment, the user can use the main brush and the secondary brush to clean the inner surface of the bottle and the outer thread at the same time. The area defined by the three shafts, (main brush, secondary brush, and short rod), is smaller that the bottle-mouth.

Figure 6:
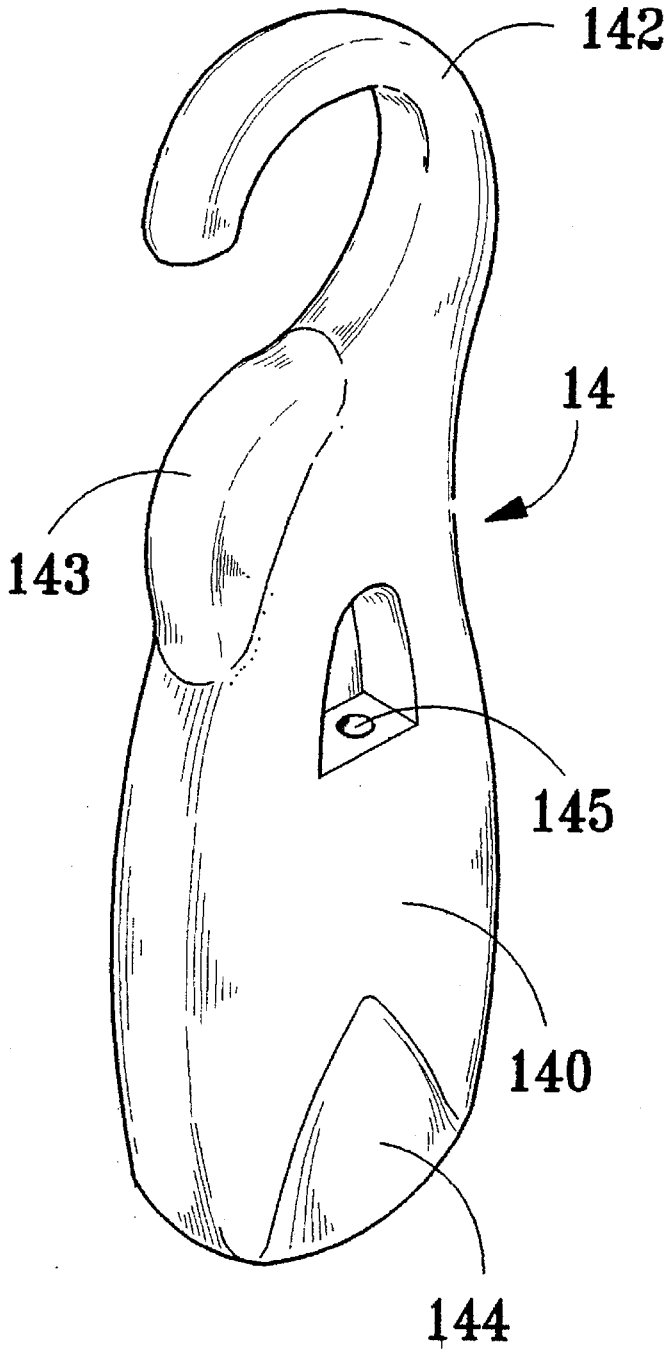
FIG. 6 is a perspective view of the handle of the present invention.

As shown in FIG. 6, one end of the handle 14 of the present invention is a hook 142. Beneath the hook 142 is a protuberance 143 that protrudes from the body 140 of the handle 14. The front and the back of the handle body 140 each has a triangular protuberance 144. One end of the connecting shaft 13 is inserted into the hole 145 in the handle body 140.

The present invention is a single unit product that is easy to store and to retrieve. It is very fast and convenient in operation, and also has complete cleaning effectiveness without expending a lot of effort.

Many changes and modifications in the above described embodiments of the invention can, of course, be carried out without departing from the scope thereof. Accordingly, to promote progress in science and the useful arts, the invention is disclosed and is intended to be limited only by the scope of the appended claims.

What is claimed is:

1. A baby bottle brush device, said brush device comprising:

an elongated main brush including a plurality of bristles supported by a main shaft, said main shaft having first and second elongated portions which are laterally and longitudinally offset with respect to one another and connected by an angled section;

an elongated second brush including a plurality of bristles supported by a second shaft, said second shaft having first and second elongated portions which are laterally and longitudinally offset with respect to one another and connected by an angled section;

an elongated connecting shaft, said connecting shaft having first and second elongated portions which are laterally and longitudinally offset with respect to one another and connected by an angled section, the second portion of the connecting shaft receives both the first portion of the main shaft and the first portion of the second shaft in an end thereof;

said first portion and angled section of the main shaft and said second portion and angled section of the connecting shaft together forming a substantially U-shape;

an elongated, substantially flat handle having first and second ends and opposed longitudinal edges, said first end of said handle has a hole therein and receives the first portion of the connecting shaft therein to couple the connecting shaft with the handle, the second end of the handle has a hook thereon, one of said opposed edges includes an arcuate protuberance thereon.

2. A baby bottle brush device as claimed in claim 1 wherein said main brush is longer than said secondary brush.

3. A baby bottle brush device as claimed in claim 1, said baby bottle brush device further comprising a rod received in said connecting shaft.

* * * * *